US006859977B2

(12) United States Patent
Morgan et al.

(10) Patent No.: US 6,859,977 B2
(45) Date of Patent: Mar. 1, 2005

(54) SECURITY STORM DOOR

(75) Inventors: Robert H. Morgan, Chapel Hill, NC (US); Richard P. Armstrong, Mt. Jewett, PA (US)

(73) Assignee: Kane Manufacturing Corporation, Chapel Hill, NC (US)

( * ) Notice: Subject to any disclaimer, the term of this patent is extended or adjusted under 35 U.S.C. 154(b) by 24 days.

(21) Appl. No.: 10/214,042

(22) Filed: Aug. 7, 2002

(65) Prior Publication Data

US 2003/0041410 A1 Mar. 6, 2003

Related U.S. Application Data

(60) Provisional application No. 60/310,586, filed on Aug. 7, 2001.

(51) Int. Cl.[7] ..... E05F 5/02

(52) U.S. Cl. ..... 16/82; 70/418; 49/402

(58) Field of Search ..... 49/401, 402, 462; 70/418, 416, 417

(56) References Cited

U.S. PATENT DOCUMENTS

| | | | | | |
|---|---|---|---|---|---|
| 553,348 | A | | 1/1896 | Mannstaedt | 49/401 |
| 1,320,494 | A | | 11/1919 | Plym | 49/470 |
| 1,329,453 | A | * | 2/1920 | Bohn | 49/401 |
| 1,814,961 | A | * | 7/1931 | Phillips | 292/346 |
| 2,960,733 | A | | 11/1960 | Nida | 49/401 |
| 3,072,229 | A | * | 1/1963 | Pasche et al. | 49/401 |
| 3,242,537 | A | * | 3/1966 | Monti | 49/402 |
| 3,296,743 | A | * | 1/1967 | Curl | 49/382 |
| 3,299,574 | A | | 1/1967 | Alexeff et al. | 49/401 |
| 3,380,193 | A | * | 4/1968 | Hill | 49/462 |
| 4,126,965 | A | * | 11/1978 | Hoffmann | 49/398 |
| 4,593,493 | A | | 6/1986 | Naka et al. | 49/248 |
| 4,644,697 | A | * | 2/1987 | Nida | 49/401 |
| 4,665,654 | A | | 5/1987 | Stedron et al. | 49/484.1 |
| 4,804,223 | A | * | 2/1989 | Iati | 296/152 |
| 5,207,036 | A | * | 5/1993 | Sampson et al. | 52/72 |
| 5,295,326 | A | | 3/1994 | Dickey | 49/482.1 |
| 5,327,684 | A | | 7/1994 | Herbst | 49/506 |
| 5,465,528 | A | | 11/1995 | Schinzel et al. | 49/368 |
| 5,483,771 | A | | 1/1996 | Herbst | 49/504 |
| 5,953,860 | A | | 9/1999 | Morgan et al. | 49/257 |
| 6,079,475 | A | | 6/2000 | Morgan et al. | 160/371 |
| 6,622,432 | B2 | * | 9/2003 | Zacher et al. | 49/501 |

* cited by examiner

*Primary Examiner*—John B. Walsh
(74) *Attorney, Agent, or Firm*—St. Onge Steward Johnston & Reens LLC

(57) ABSTRACT

A security closure assembly for a door or a window in an opening of a building for preventing unauthorized access therethrough when in a secured position and for allowing ingress to and egress from the building when in an open position is provided. The security closure assembly includes a jamb having an outwardly facing surface and a jamb flange protruding outwardly from the outwardly facing surface of the jamb. The security closure assembly also includes a frame which fits within said jamb with a space defined between the frame and the jamb. A protrusion extends from the frame which overlays the space defined between the frame and the jamb. The protrusion has a channel which surrounds the jamb flange when the frame is in the secured position.

27 Claims, 4 Drawing Sheets

SECURITY STORM DOOR

This application claims the benefit of, under 35 U.S.C. 119(e), U.S. Provisional Patent Application No. 60/310,586, filed on Aug. 7, 2001.

FIELD OF THE INVENTION

The present invention relates to a security closure assembly, and more particularly to a security screen assembly installable in the jamb of a building window or door for preventing unauthorized access therethrough, while allowing for quick and easy access into and out of the building.

BACKGROUND OF THE INVENTION

It is common practice to protect the windows of a building, especially those on the ground floor level, from unauthorized entry by means of window guards. Traditionally, such window guards have consisted of heavy gauge wire mesh screens or metal bars which are permanently attached to the building. A permanently installed window guard has a number of disadvantages, however, the primary disadvantage being that in the event of a fire or other emergency, it is not possible to leave the building through the guarded window. One must therefore find another means of escape, which means may not be available. Additionally, such permanent guards are not suitable for doors and other entryways that must permit access therethrough yet may still require the protection provided by the guards. This disclosure refers to a screen assembly, and is applicable to a screen assembly in a door or window or to any door or window or jambed opening.

Access can be unauthorizedly gained through openings in buildings by applying a prying force at the space defined by the screen assembly for a window or door and the surrounding jamb. An effectively applied prying force is capable of overcoming known security measures such as various locks and the use of high strength materials in manufacturing the screen assembly. It is necessary to develop a screen assembly frame for a window or door which would deny access to a prying force applied between the screen assembly frame and the jamb. It is further necessary to develop a screen assembly frame for a window or door that ensures than any prying force that could be applied at the space between the assembly frame and the jamb would not be effective in prying open the assembly. This invention provides a structure for the screen assembly and jamb that solves these problems.

Of some interest to this disclosure is U.S. Pat. No. 5,295,326 to Dickey. The '326 patent discloses a self-adjusting weather-proof seal for doors, windows and other closures that automatically accommodates warping, settling or other movement of the closure and its frame. A weather stripping flange is mounted on one or more sides of a closure or closure frame, and is adapted to be received in a compatible receptacle on the closure frame or closure, respectively. The weather stripping flange is coupled to an adjustment assembly that permits frictionally restricted movement of the flange. This capability for frictionally restricted movement allows the flange automatically to become inserted into the receptacle as the door or other closure is moved to a closed position, even if the closure and closure frame are significantly out-of-square or warped.

The '326 patent is distinguishable because it discloses a channel secured to an inside surface of the doorjamb. The present invention provides a channel protruding from the screen assembly frame and not from the jamb and overlaying the space defined between the screen assembly frame and the jamb to prevent access to that space. A channel provided on an inside surface of the jamb could never prevent access to the space between the assembly frame and the jamb on the outer side of the assembly. The '326 patent further is distinguishable because it utilizes a flange secured to a door rather than a flange protruding from the outward surface of the door jam. Again, none of the security benefits provided by the present invention are offered by the '326 patent because of the structural differences disclosed in the patent.

The present invention works in concert with known methods of securing windows and doors. Accordingly, inventions such as U.S. Pat. No. 6,079,475 to Morgan, et al. which relates to the field of metal protection screens and, in particular, to screens designed and manufactured for deterring forced entry and vandalism is wholly incorporated herein. The '475 patent provides a security screen having a mechanism to increase resistance to displacement due to a force applied to the screen cloth. It also provides a security screen of the above character wherein the mechanism to increase resistance to displacement also serves to prevent the screen from being pried open.

What is desired therefore is a security closure assembly for an opening in a building for preventing unauthorized access therethrough when in a secured position and for allowing ingress to and egress from the building when in an open position, which denies access to a prying force at the space defined between the screen assembly frame and the jamb, which ensures that a prying force on the screen assembly will necessarily be at a disadvantageous angle, which provides that a prying instrument inserted at the seam formed between the screen assembly frame and the jamb would have only a shallow lip upon which to leverage a prying force, and which if any leverage against the screen assembly is obtained with a prying force, provides a dynamic that interferes with further movement in response to the prying force.

SUMMARY OF THE INVENTION

Accordingly, it is an object of the invention to provide a security closure assembly for an opening in a building for preventing unauthorized access therethrough when in a secured position and for allowing ingress to and egress from the building when in an open position.

It is a further object of the invention to provide a security closure assembly which denies access to a prying force at the space defined between the screen assembly frame and the jamb.

It is a further object of the invention to provide a security closure assembly which ensures that any attempt to apply a prying force to open the screen assembly will necessarily be at a disadvantageous angle making any attempt to pry open the assembly ineffective.

It is a further object of the invention to provide a security closure assembly which any prying instrument inserted at the seam formed between the channel and the outward face of the jamb would immediately contact the flange leaving only a shallow lip upon which to leverage a prying force making any attempt to pry open the assembly ineffective.

It is a further object of the invention to provide a security closure assembly which if any leverage against the screen assembly is obtained with a prying force, the flange contacts and interferes with the inner surface of the channel preventing the screen assembly from opening making any attempt to pry open the assembly ineffective.

These and other aspects of the invention are achieved in an embodiment by provision of a jamb having an outwardly facing surface; a jamb flange protruding outwardly from the outwardly facing surface of the jamb; a frame that fits within the jamb with a space defined between the frame and the jamb; a protrusion extending from the frame; the protrusion overlaying the space defined between the frame and the jamb and having a channel which surrounds the jamb flange when the frame is in the secured position.

It is preferable that the invention may provide a security closure assembly wherein a prying force applied between the outwardly facing surface of the jamb and the channel causes the jamb flange to interfere with the channel.

It is preferable that the invention may provide a security closure assembly wherein the jamb comprises an outer flange which is generally parallel to and at least partially abuts the outer surface of the building and further comprising a jamb body, generally perpendicular to the outer flange, wherein the outer flange and the jamb body form a generally L-shaped configuration.

It is preferable that the invention may provide a security closure assembly wherein the jamb is generally Z-shaped and may further comprise an inner flange, generally parallel to the outwardly facing surface, which extends towards the frame and beyond the space between the frame and the jamb such that when the frame is in the secured position, the frame abuts and forms a seal with the inner flange of the jamb.

It is preferable that the invention may provide a security closure assembly wherein a pocket is provided on the inner flange of the jamb and further comprising insulating material inserted in the pocket such that a seal is formed between the frame and the insulating material when the frame is in the secured position.

It is preferable that the invention may provide a security closure assembly wherein the frame is a window frame or a door frame or particularly a full view security door.

It is preferable that the invention may provide a security closure assembly wherein the frame is hingedly attached to the jamb on a hinged side of the security closure assembly or where the jamb flange and the protrusion are on a side opposite from the hinged side of the security closure assembly.

In another embodiment the aspects of the invention are achieved by provision of a jamb insertable into an opening in a building; the jamb comprising an outer flange which is parallel to and at least partially abuts the outer surface of the building; the outer flange having an outwardly facing surface; the jamb further comprising a jamb body, perpendicular to the outer flange wherein the outer flange and the jamb body form a generally L-shape; a jamb flange protruding outwardly from the outwardly facing surface of the jamb; a frame, wherein the frame fits within the jamb with a space defined between the frame and the jamb; a protrusion extending from the frame; the protrusion overlaying the space defined between the frame and the jamb and having a channel which surrounds the jamb flange when the frame is in the secured position; wherein a prying force applied between the outwardly facing surface of the jamb and the channel causes the jamb flange to interfere with the channel.

In still another embodiment the aspects of the invention are achieved by provision of a jamb insertable into an opening in a building; the jamb comprising an outer flange which is parallel to and at least partially abuts the outer surface of the building; the outer flange having an outwardly facing surface; the jamb further comprising an jamb body, perpendicular to the outer flange wherein the outer flange and the jamb body form a generally L-shape; a jamb flange protruding outwardly from the outwardly facing surface of the jamb; a frame, wherein the frame fits within the jamb with a space defined between the frame and the jamb; a protrusion extending from the frame; the protrusion overlaying the space defined between the frame and the jamb and having a channel which surrounds the jamb flange when the frame is in the secured position; wherein a prying force applied between the outwardly facing surface of the jamb and the channel causes the jamb flange to interfere with the channel; wherein the frame is hingedly attached to the jamb on a hinged side of the security closure assembly; wherein the jamb flange and the protrusion are on a side opposite from the hinged side of the security closure assembly.

The invention and its particular features and advantages will become more apparent from the following detailed description considered with reference to the accompanying drawings.

BRIEF DESCRIPTION OF THE DRAWINGS

The present invention may be more clearly understood from the following description of a specific and preferred embodiment read in conjunction with the accompanying detailed drawings; wherein.

DETAILED DESCRIPTION OF THE INVENTION

Figure 1:
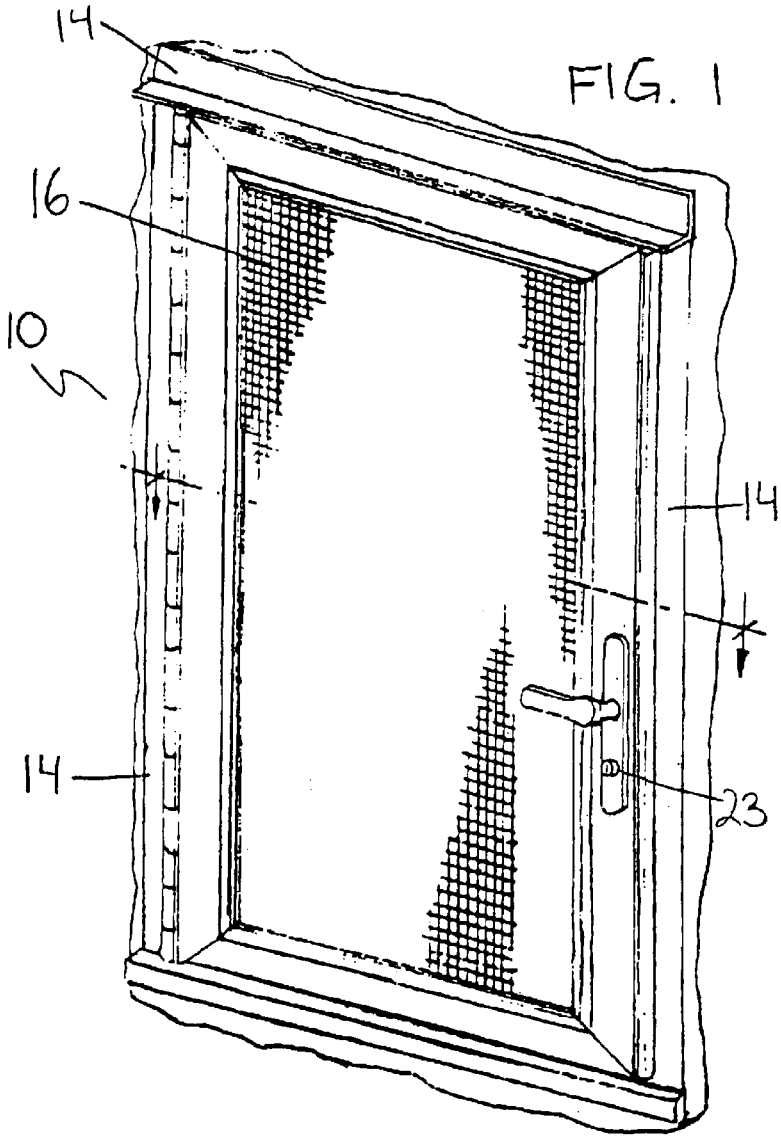
FIG. 1 is a perspective view of a security screen assembly in accordance with the invention.

The present invention relates to a security closure assembly, and more particularly to a security screen assembly installable in the jamb of a building window or door for preventing unauthorized access therethrough, while allowing for quick and easy access into and out of the building. The invention however can be applied to any door or window where the security provided by the invention is desired.

The invention provides for a screen assembly that fits within a jamb that is secured to a building. The screen assembly and jamb may be of any number of materials, such as steel, aluminum or plastics and other relatively high strength material.

A protrusion extends along an edge of the screen assembly which extends beyond the width of the screen assembly and overlaps the jamb. This protrusion overlays the space between the screen assembly and the jamb on the outward side of the opening. The protrusion effectively prevents access to a prying force from the outside of the building to the space between the screen assembly and the jamb.

The protrusion should extend from an edge of the screen assembly on any side that is susceptible to a prying force. Commonly, it will be appropriate for the protrusion to extend from a stile or rail on the lock side or the side remote to the hinged stile or rail.

The protrusion meets the outward facing surface of the jamb forming a seam along the length of the channel. This seam may also be susceptible to a prying force. However, the meeting of the protrusion at the outward face of the jamb ensures that little effective room is available for the application of a prying force. In fact, any attempt to apply a prying force at this seam will necessarily be at a mechanically disadvantageous angle making an attempt to pry open the assembly ineffective.

The structure of the jamb and its cooperation with the protrusion provides further security benefits to overcome the susceptibly of the seam to a prying force. The invention provides for a jamb that has an outwardly protruding flange. The flange is situated to be surrounded by a channel which is formed in the protrusion when the screen assembly is in a closed secured position. The flange may protrude from anywhere along the outward surface of the jamb provided that the channel is correspondingly positioned to surround the flange.

Any prying instrument inserted at the seam formed between the channel and the outward face of the jamb would be blocked by the flange. The interference the flange effects on a prying instrument guarantees that only a shallow contact area is presented upon which to leverage a prying force.

Further, in the unlikely case that sufficient leverage is achieved by a prying instrument to cause the screen assembly to move, a dynamic occurs between the flange and the inside surface of the channel. The movement of the screen assembly in response to a prying force brings the flange into contact with the inner surface of the channel. The resulting interference between the flange and the channel prevents the screen assembly from being opened.

DETAILED DESCRIPTION OF THE DRAWINGS

Figure 2:
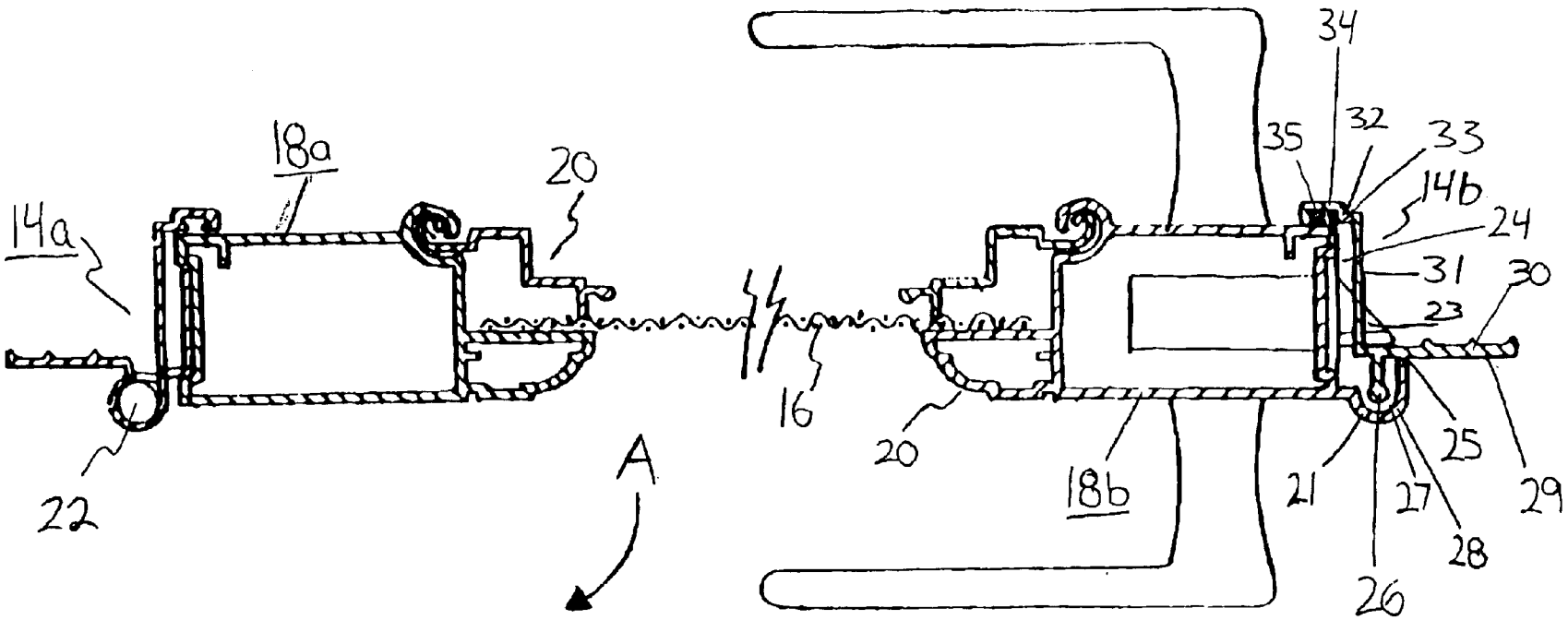
FIG. 2 is a cross-sectional top view of the security screen assembly shown in FIG. 1.

The present invention relates to a security storm door assembly 10 shown in FIG. 1. As shown in a cross-sectional view in FIG. 2, the system 10 comprises a screen assembly 12 hingedly mounted in a doorjamb 14 (FIG. 1). The door jamb 14 includes a hinge jamb 14*a* and a lock jamb 14*b*. The screen assembly 12 includes a screening material 16 anchored within the screen frame 18 by appropriate screening material retaining members 20, such as screws, clamping mechanisms or any other suitable means. The screen frame 18 includes a hinge side frame 18*a* and a lock side frame 18*b*. Although numerous materials may be used to form the screening material 16, such as heavy gauge wire mesh or a solid metal sheet, the screening material 16 is preferably formed from a sheet of perforated metal to allow for visibility and ventilation therethrough while providing a high level of security. It is to be understood that the particular screen assembly 12 shown is for example only and that any type of screen assembly known in the art may be used depending on the level of security desired. The screen assembly 12 is outwardly pivotal about a hinge assembly 22 to an open position as generally indicated by arrow A. The hinge assembly 22 may comprise piano hinges, butt hinges, bearing hinges or any other suitable hinge according to the desired security and functionality. The screen assembly 12 is securely closed by means of a lock 23.

Figure 4:
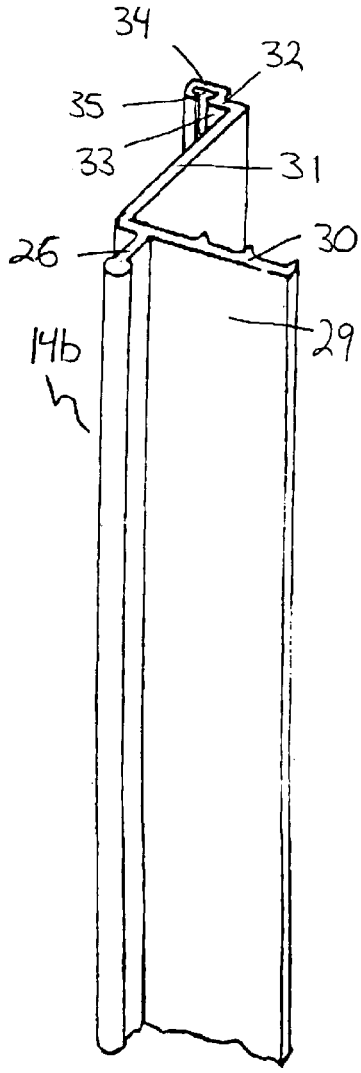
FIG. 4 is a perspective view of the door jamb of the security screen assembly of FIG. 1.
Figure 6:
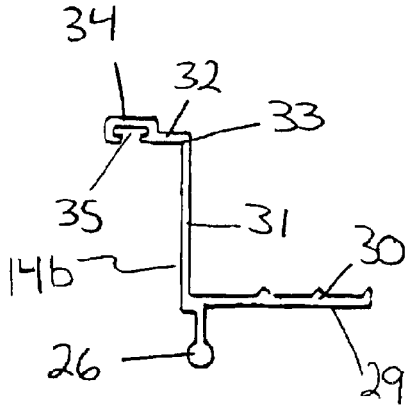
FIG. 6 is a cross-sectional top view of the door jamb shown in FIG. 4.

The lock jamb 14*b* is seen in greater detail in FIGS. 4 and 6. The lock jamb 14*b* is generally Z-shaped having a flange 26 extending outwardly. The lock jamb 14*b* has an outwardly facing front surface 29 on the outer flange 30 and has an outwardly facing rear surface 33 on the inner flange 32. The lock jamb 14*b* also includes a jamb body 31.

Figure 3:
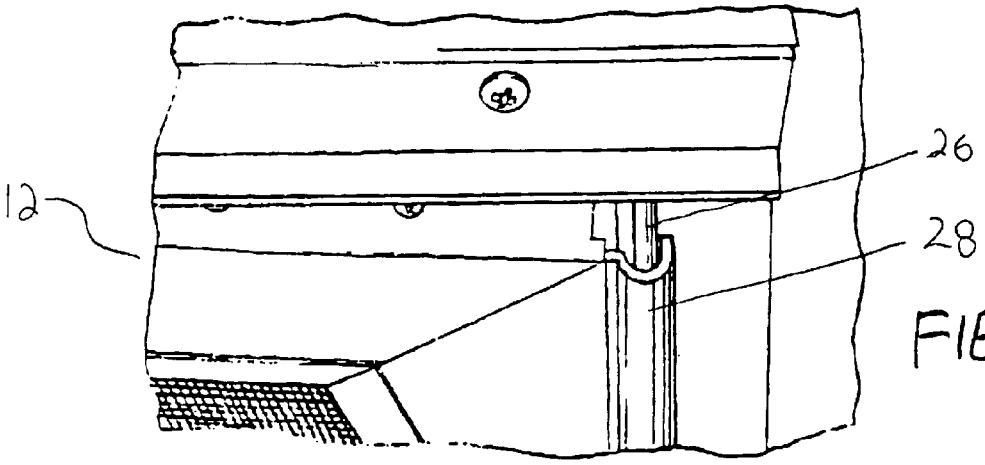
FIG. 3 is a close up perspective view of the security screen assembly shown in FIG. 1, showing the channel and flange in greater detail.
Figure 5:
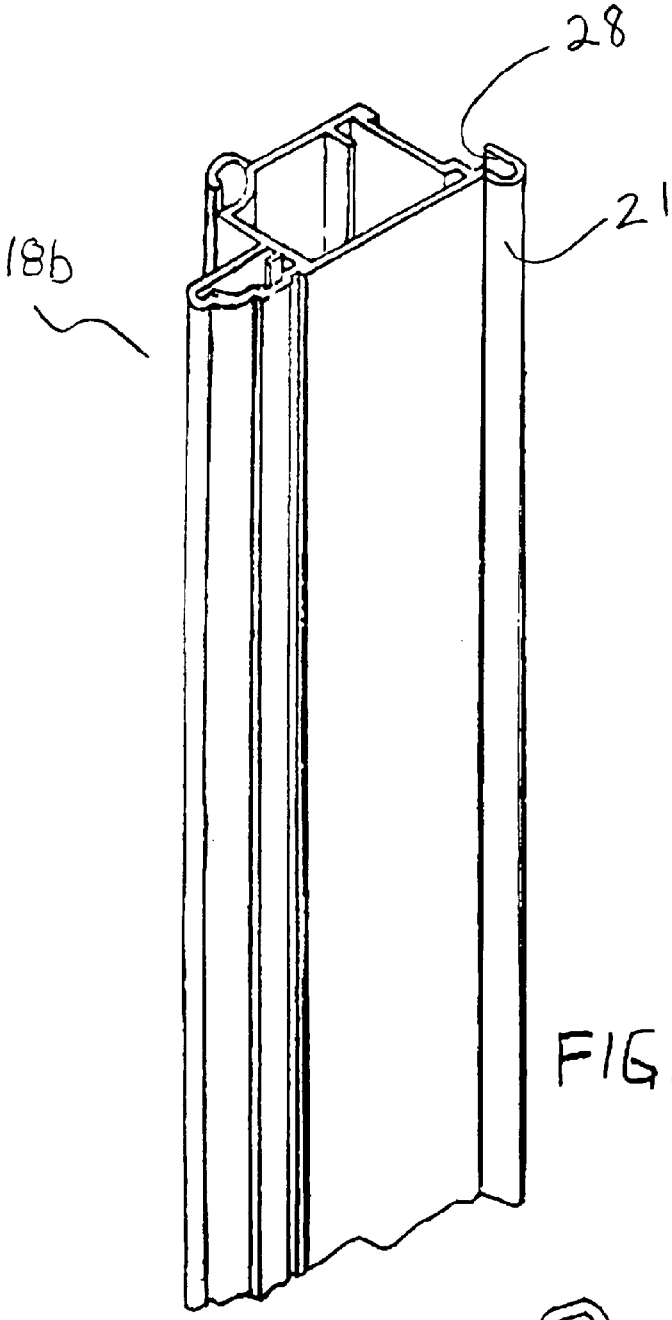
FIG. 5 is a perspective view of the door frame of the security screen assembly of FIG. 1.
Figure 7:
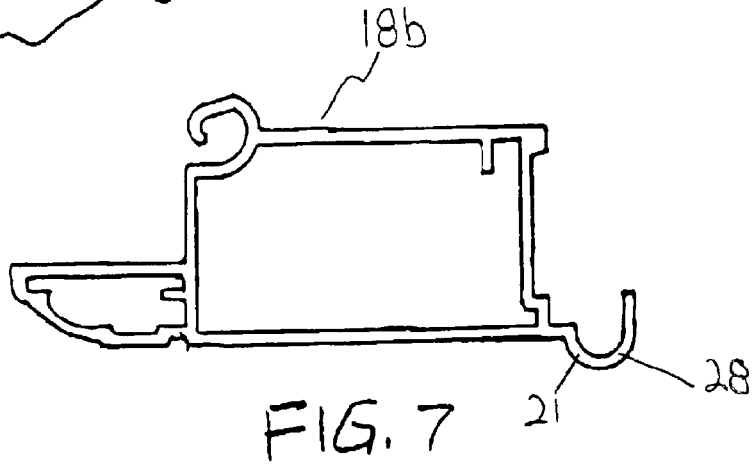
FIG. 7 is a cross-sectional top view of the door frame shown in FIG. 5.
Figure 8:
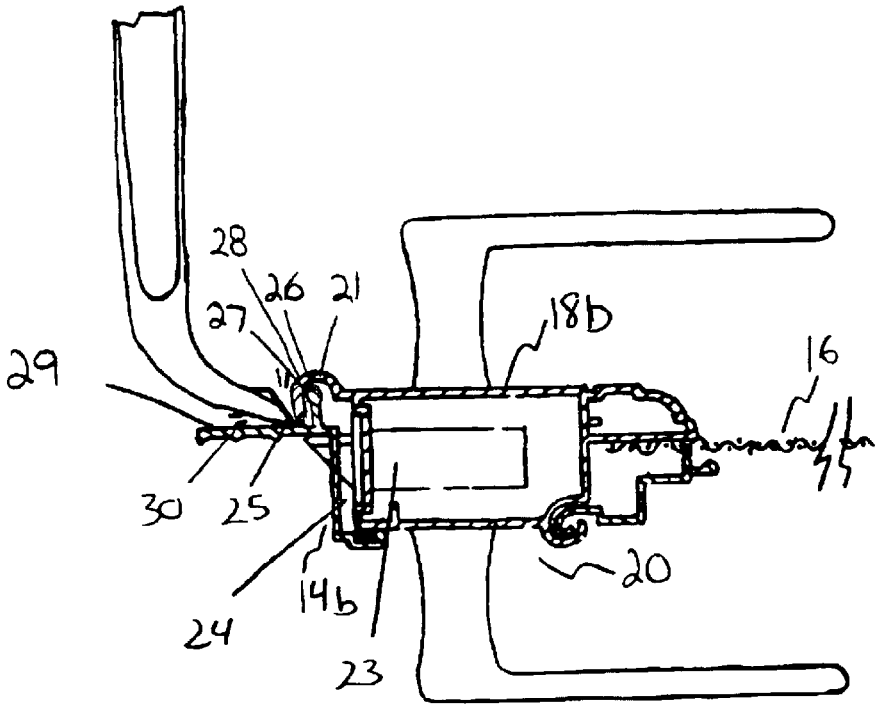
FIG. 8 is a cross-sectional top view of the security screen assembly shown in FIG. 1 showing a prying force being applied to the security screen assembly.
Figure 9:
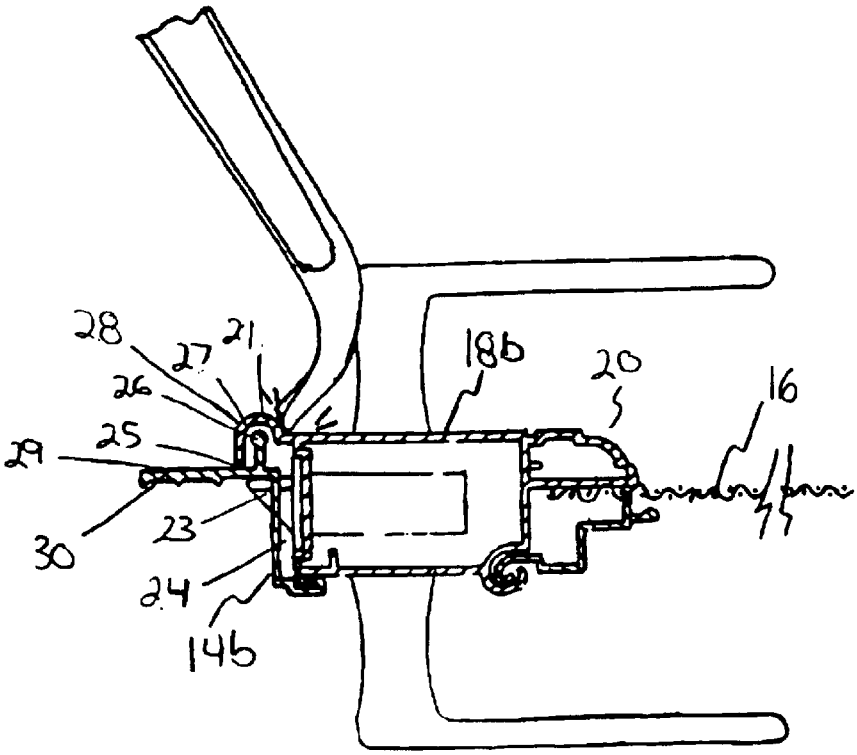
FIG. 9 is a cross-sectional top view of the security screen assembly shown in FIG. 1 showing a prying force being applied to the security screen assembly from another angle.

The lock side screen frame 18*b* is shown in greater detail in FIGS. 5 and 7. The lock side screen frame 18*b* has a U-shaped channel 28 formed in a protrusion 21 that extends beyond the width of the jamb opening. The U-shaped channel 28 is correspondingly located on the screen frame 18*b* to engage and surround the flange 26 when the screen assembly 12 is in the closed position (as shown in FIG. 3). The protrusion 21 overlays the space 24 defined between the doorjamb 14*b* and the screen frame 18*b*. (see FIGS. 2, 8 and 9) The overlapping of the outer flange 30 and the protrusion 21 blocks the application of a prying force at the space 24 defined between the door jamb 14*b* and the screen frame 18*b* thereby preventing the screen assembly 12 from being pried open by burglars or others seeking unauthorized entry. (FIG. 9)

The U-shaped channel 28 forms a seam 25 along the edge where channel 28 meets the outwardly facing front surface 29 of outer flange 30. A prying instrument introduced at seam 25 would necessarily be at a mechanically disadvantageous angle to pry the screen assembly 12 open. (FIG. 8) Further, a prying instrument introduced at seam 25 would make contact with flange 26, preventing the instrument from obtaining sufficient leverage to gain entry. Finally, if a prying force was introduced at seam 25 and the screen assembly 12 was moved, flange 26 would contact and interfere with the inner surface 27 of the U-shaped channel 28 preventing further movement of the screen assembly maintaining the security of the assembly as shown in FIG. 8.

Preferably, a pocket 34 is provided on the lock jamb 14*b* that receives an insulating material 35 to form at least a partial seal between the lock jamb 14*b* and the screen assembly 12 to prevent penetration of liquid and wind inside the structure.

While the above description refers primarily to an assembly for a door, it is to be understood that the invention may be also directed toward guards for windows and other such openings in a structure.

The present invention therefore provides a security closure assembly for an opening in a building for preventing unauthorized access therethrough when in a secured position and for allowing ingress to and egress from the building when in an open position, which denies access to a prying force at the space defined between the screen assembly frame and the jamb, which ensures that a prying force on the screen assembly will necessarily be at a disadvantageous angle, which provides that a prying instrument inserted at the seam formed between the screen assembly frame and the jamb would have only a shallow lip upon which to leverage a prying force, and which if any leverage against the screen assembly is obtained with a prying force, provides a dynamic that interferes with further movement in response to the prying force.

Although the invention has been described with reference to a particular arrangement of parts, features and the like, these are not intended to exhaust all possible arrangements or features, and indeed many other modifications and variations will be ascertainable to those of skill in the art.

What is claimed is:

1. A security closure assembly for an opening in a building for preventing unauthorized access therethrough when in a secured position and for allowing ingress to and egress from the building when in an open position, said security closure assembly comprising:

a jamb, said jamb comprising an outwardly facing surface and an integral jamb flange protruding outwardly from said outwardly facing surface of said jamb;

a frame, wherein said frame fits within said jamb with a space defined between said frame and said jamb:

a protrusion extending from said frame, said protrusion overlaying said space defined between said frame and said jamb and having a channel formed therein which surrounds said jamb flange when said frame is in the secured position; and wherein said jamb further comprises an inner flange, generally parallel to said outwardly facing surface, which extends towards said frame and beyond said space between said frame and said jamb such that when said frame is in said secured position, said frame abuts and forms a seal with said inner flange of said jamb.

2. An assembly defined in claim 1 wherein a prying force applied between said outwardly facing surface of said jamb and said channel causes said jamb flange to interfere with said channel.

3. An assembly defined in claim 1 wherein said jamb comprises an outer flange which is generally parallel to and at least partially abuts the outer surface of said building and further comprising a jamb body, generally perpendicular to the outer flange, wherein said outer flange and said jamb body form a generally L-shaped configuration.

4. An assembly defined in claim 1 wherein said jamb comprises an outer flange which is generally parallel to and at least partially abuts the outer surface of said building, a jamb body, generally perpendicular to the outer flange, and an inner flange, generally parallel to said outwardly facing surface, which extends towards said frame and beyond said space between said frame and said jamb such that said outer flange, said jamb body and inner flange form a generally Z-shaped configuration.

5. An assembly defined in claim 1 wherein a pocket is provided on said inner flange of said jamb and further comprising insulating material inserted in the pocket such that a seal is formed between said frame and said insulating material when said frame is in said secured position.

6. An assembly defined in claim 1 wherein said frame is a window frame.

7. An assembly defined in claim 1 wherein said frame is a door frame.

8. An assembly defined in claim 7 wherein said door frame comprises a full view security door.

9. An assembly defined in claim 1 wherein said frame is hingedly attached to said jamb on a hinged side of said security closure assembly.

10. An assembly defined in claim 9 wherein said jamb flange and said protrusion are on a side opposite from said hinged side of said security closure assembly.

11. A security closure assembly for an opening in a building for preventing unauthorized access therethrough when in a secured position and for allowing ingress to and egress from the building when in an open position, said security closure assembly comprising:

a jamb, said jamb insertable into an opening in a building, said jamb comprising an outer flange having an outwardly facing surface, which outer flange is generally parallel to and at least partially abuts an outer surface of the building, and a jamb body, generally perpendicular to the outer flange, wherein said outer flange and said jamb body form a generally L-shaped configuration;

a jamb flange, integral with said jamb, protruding outwardly from said outwardly facing surface of said outer flange;

a frame, wherein said frame fits within said jamb with a space defined between said frame and said jamb; and a protrusion extending from said frame, said protrusion overlaying said space defined between said frame and said jamb and having a channel formed therein which surrounds said jamb flange when said frame is in the secured position;

wherein a prying force applied between said outwardly facing surface of said jamb and said channel causes said jamb flange to interfere with said channel.

12. An assembly defined in claim 11 wherein said jamb further comprises an inner flange, generally parallel to said outer flange, which extends towards said frame and beyond said space between said frame and said jamb such that when said frame is in said secured position, said frame abuts and forms a seal with said inner flange of said jamb.

13. An assembly defined in claim 12 wherein a pocket is provided on said inner flange of said jamb and further comprising insulating material inserted in the pocket such that a seal is formed between said frame and insulating material when said frame is in said secured position.

14. An assembly defined in claim 11 wherein said frame is a window frame.

15. An assembly defined in claim 11 wherein said frame is a door frame.

16. An assembly defined in claim 15 wherein said a door frame comprises a full view security door.

17. An assembly defined in claim 11 wherein said frame is hingedly attached to said jamb on a hinged side of said security closure assembly.

18. An assembly defined in claim 17 wherein said jamb flange and said protrusion are on a side opposite from said hinged side of said security closure assembly.

19. A security closure assembly for an opening in a building for preventing unauthorized access therethrough when in a secured position and for allowing ingress to and egress from the building when in an open position, said security closure assembly comprising:

a jamb, said jamb insertable into an opening in a building, said jamb comprising an outer flange having an outwardly facing surface, which outer flange is generally parallel to and at least partially abuts an outer surface of the building, and a jamb body, generally perpendicular to the outer flange, wherein said outer flange and said jamb body form a generally L-shaped configuration;

a jamb flange, integral with said jamb, protruding outwardly from said outwardly facing surface of said outer flange;

a frame, wherein said frame fits within said jamb with a space defined between said frame and said jamb;

a protrusion extending from said frame, said protrusion overlaying said space defined between said frame and said jamb and having a channel formed therein which surrounds said jamb flange when said frame is in the secured position;

wherein a prying force applied between said outwardly facing surface of said jamb and said channel causes said jamb flange to interfere with said channel;

wherein said frame is hingedly attached to said jamb on a hinged side of said security closure assembly; and wherein said jamb flange and said protrusion are on a side opposite from said hinged side of said security closure assembly.

20. An assembly defined in claim 19 wherein said jamb further comprises an inner flange, generally parallel to said outer flange, which extends towards said frame and beyond said space between said frame and said jamb such that when said frame is in said secured position, said frame abuts and forms a seal with said inner flange of said jamb.

21. An assembly defined in claim 20 wherein a pocket is provided on said inner flange of said jamb and further comprising insulating material inserted in the pocket such that a seal is formed between said frame and said insulating material when said frame is in said secured position.

22. An assembly defined in claim 19 wherein said frame is a window frame.

23. An assembly defined in claim 19 wherein said frame is a door frame.

24. An assembly defined in claim 23 wherein said a door frame comprises a full view security door.

25. An assembly defined in claim 1 wherein said jamb and jamb flange are made of a high strength material.

26. A security closure assembly for an opening in a building for preventing unauthorized access therethrough when in a secured position and for allowing ingress to and egress from the building when in an open position, said security closure assembly comprising:

a jamb, said jamb comprising an outwardly facing surface and an integral jamb flange protruding outwardly from said outwardly facing surface of said jamb;

a frame, wherein said frame fits within said jamb with a space defined between said frame and said jamb;

a protrusion extending from said frame, said protrusion overlaying said space defined between said frame and said jamb and having a channel formed therein which surrounds said jamb flange when said frame is in the secured position; and wherein said jamb comprises an outer flange which is generally parallel to and at least partially abuts the outer surface of said building and further comprising a jamb body, generally perpendicular to the outer flange, wherein said outer flange and said jamb body form a generally L-shaped configuration.

27. A security closure assembly for an opening in a building for preventing unauthorized access therethrough when in a secured position and for allowing ingress to and egress from the building when in an open position, said security closure assembly comprising:

a jamb, said jamb comprising an outwardly facing surface and an integral jamb flange protruding outwardly from said outwardly facing surface of said jamb;

a frame, wherein said frame fits within said jamb with a space defined between said frame and said jamb;

a protrusion extending from said frame, said protrusion overlaying said space defined between said frame and said jamb and having a channel formed therein which surrounds said jamb flange when said frame is in the secured position; and wherein said jamb comprises an outer flange which is generally parallel to and at least partially abuts the outer surface of said building, a jamb body, generally perpendicular to the outer flange, and an inner flange, generally parallel to said outwardly facing surface, which extends towards said frame and beyond said space between said frame and said jamb such that said outer flange, said jamb body and inner flange form a generally Z-shaped configuration.

* * * * *